United States Patent [19]

Bateman et al.

[11] Patent Number: 4,465,305

[45] Date of Patent: Aug. 14, 1984

[54] CHECKBOOK, CHECKS, AND CHECK STUBS

[75] Inventors: John L. Bateman, Cockeysville; Stanley J. Mitchell, Belair, both of Md.

[73] Assignee: American Standard Inc., New York, N.Y.

[21] Appl. No.: 336,143

[22] Filed: Dec. 31, 1981

[51] Int. Cl.[3] ..... B42D 3/00

[52] U.S. Cl. ..... 281/31; 283/58; 283/66 A; 282/DIG. 1

[58] Field of Search ..... 283/57, 58, 109, 59, 283/66 A; 281/31; 282/DIG. 1

[56] References Cited

U.S. PATENT DOCUMENTS

| | | | |
|---|---|---|---|
| 835,703 | 11/1906 | Davis | 283/59 X |
| 938,909 | 11/1909 | Sultzer | 281/31 X |
| 1,367,754 | 2/1921 | Patton | 283/59 |
| 2,678,223 | 5/1954 | Shepherd | 283/58 X |
| 3,048,426 | 8/1962 | Rodriguez et al. | 283/58 X |
| 3,620,553 | 11/1971 | Donovan | 282/8 C |
| 3,861,718 | 1/1975 | Strus | 281/17 |

*Primary Examiner*—Donald R. Schran
*Assistant Examiner*—James Wolfe
*Attorney, Agent, or Firm*—Robert G. Crooks; James J. Salerno, Jr.; John P. Sinnott

[57] ABSTRACT

This efficient checking account record keeping and check disposal system, including a method of producing the negotiable instruments for the system, provides checks and check stubs on which information pertinent to the functioning of a checking account may be stored conveniently and efficiently. The invention also is directed to a method of printing the checks and stubs in which the "safety paper" background design may be selectively printed and in which information spaces on the back of said stubs may be printed along with the printing of the background design in one operation.

1 Claim, 4 Drawing Figures

CHECKBOOK, CHECKS, AND CHECK STUBS

TECHNICAL FIELD

This invention relates to negotiable instrument manufacturing and disposal techniques, and more specifically, to methods for printing and disposing of check and check stub combinations, including "non-check" checking account transaction registers, and the like.

BACKGROUND ART

With the advent of automated teller machine transactions, preauthorized payments, telephone bill payments, and other ways of transferring funds from a checking account without using a check, means are needed for conveniently and accurately keeping a record of these "non-check" transactions, as well as to produce and dispose of the required printed materials. It has been a simple matter to keep a convenient and accurate record of these non-check transactions in a checkbook system in which a separate transaction register is employed, where there is, in effect, no limit on space for recording deposits and withdrawals. For checkbook systems which rely on the use of an individual check stub for each check, however, there has been no convenient and accurate way of indicating withdrawals from the checking account made by means other than a check, such as those listed above. Because many people carry out a number of non-check transactions between the writing of each check, it can be inconvenient and confusing for them to try crowd a record of several non-check transactions into or between spaces on a small check stub.

Another result of new banking methods has been the proliferation of paraphernalia relating to a person's checking account in addition to checks and deposit slips, such as plastic credit card-type transaction cards and computer printed automated teller machine receipts. It would be welcome as convenient and safe to all persons who use these items to have all their checking account paraphernalia conveniently and safely in one place.

For many years, negotiable instrument "safety paper" with its characteristic background designs, has been produced by means of a flexographic dry process or a wet web process used during the manufacturing of the paper. In these processes, the manufacturer has no control over the finished sheeted pattern, and hence cannot selectively place information without overprinting a finished piece of "safety paper", nor can he drop out the "safety paper" design where it is not necessary. Accordingly, stubs as well as checks have carried the "safety paper" background, and any information on the checks or stubs has been placed there by overprinting the finished sheet of "safety paper". In the stub the background may serve only to obscure entries and the printing of it requires the use of more ink than would be necessary if the "safety paper" design could be dropped out where it is unnecessary.

It is also important to produce materials of this character as inexpensively as possible, consistent with a good quality product. Considering the vast number of checks, check stubs and other blank negotiable instrument forms that are manufactured in any given year, savings in ink and other costs of production that are, from the viewpoint of a single printed sheet, of an almost trivial nature, become, when summed over one year's production, a major saving for manufacturer and consumer alike.

DISCLOSURE OF THE INVENTION

Accordingly, it is an object of this invention to provide a check stub record keeping system which will enable a person to keep a convenient and accurate record of all checking account transactions.

It is a further object of this invention to provide a more efficient method for manufacturing blank checks and stubs of the foregoing type.

Another object of this invention is to provide a means by which the paraphernalia which relates to modern banking practices may be kept conveniently together with the checks.

Briefly, these and other objects of the invention are accomplished by printing a check stub on both sides in a manner that leaves spaces on the back of each stub for entering non-check transactions.

In addition, the inside of a ckeckbook cover enclosing a book of these check and stub blanks has pockets in which deposit slips and bank machine receipts may be easily stored. Further, the cover of one of the pockets has a clear plastic "over-cover" with several slits. Between each adjacent pair of slits, the clear plastic overcover is joined to the cover of the pocket so that bank cards, machine receipts, and the like may be kept in individual credit-card sized compartments.

The features and advantages of the invention are expressed in more complete detail in the following description of a specific embodiment of the invention. The scope of the invention, however, is limited only by the claims.

BEST MODE OF CARRYING OUT THE INVENTION

Figure 1:
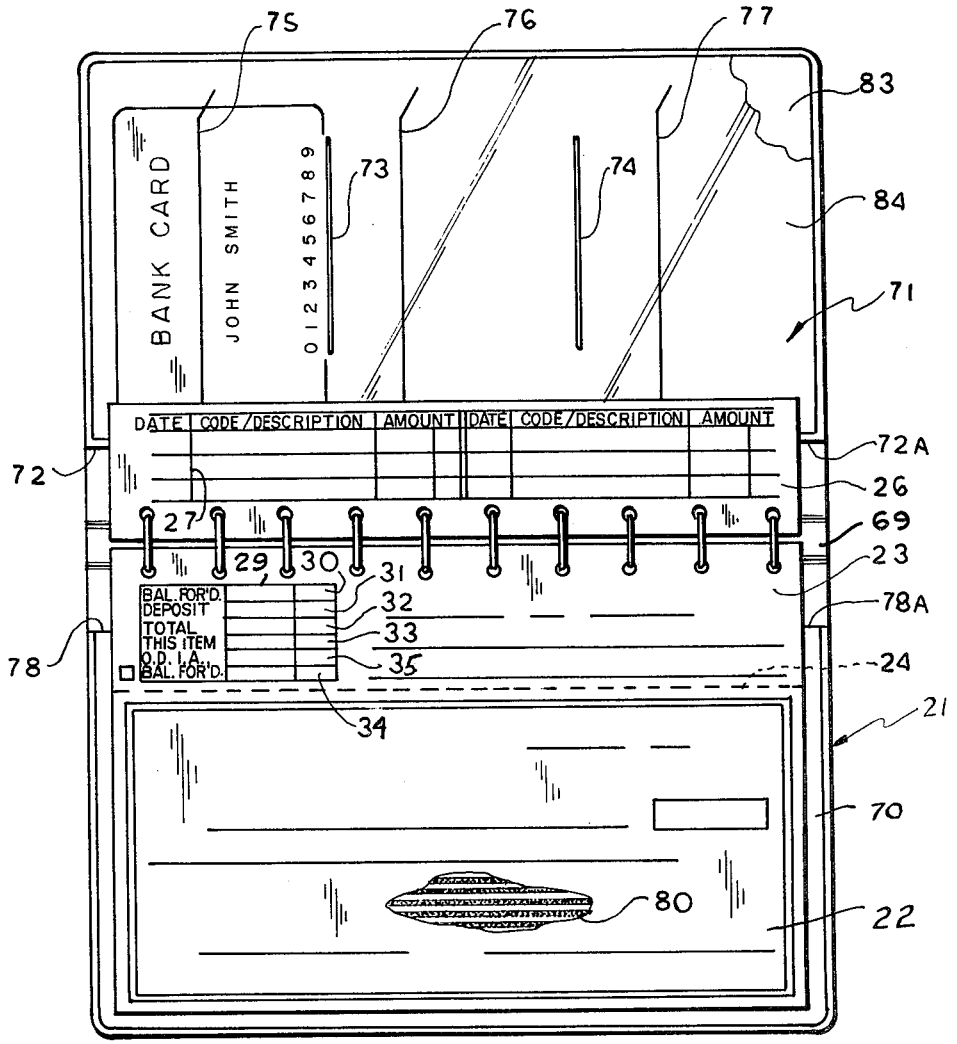
FIG. 1 is a top view of an open "top-stub" style checkbook with checks and stubs, that embodies features of the invention.

For a more thorough understanding of the invention, attention is invited to FIG. 1, which shows an open "top-stub" style checkbook 21, provided with a ring binder 69. The forward side of a check 22 and stub 23 are shown, with the borken line 24 indicating the score line between them. A view of the reverse side of the previous stub 26 is shown in position after having been flipped over in the checkbook after the detaching of its accompanying check. The solid lines 27 within the outline of the stub 26 indicate the printing on the back of all stubs in the checkbook, providing space in which non-check transactions may be conveniently entered with date, description, and amount.

The solid lines 29 within the outline of the forward side of the stub 23 indicate the printing on the upper side of all stubs in the checkbook. This printing provides the usual spaces, 30 through 34, for dollars and cents entries: "BAL. FOR'D" 30, "DEPOSIT" 31, "TO- TAL" 32, "THIS ITEM" 33, and new "BAL. FOR'D" 34. In addition to the usual spaces, there is a space 35 labeled "OTHER DED. (IF ANY)". In this space 35 the total of all non-check deductions entered on the reverse side of the previous stub 26 is to be entered and deducted from the balance forwarded, along with the amount in space 33 labeled "THIS ITEM", referring, of course to the amount of check 22. Thus there is a neat, clear record of all transactions.

Figure 2:
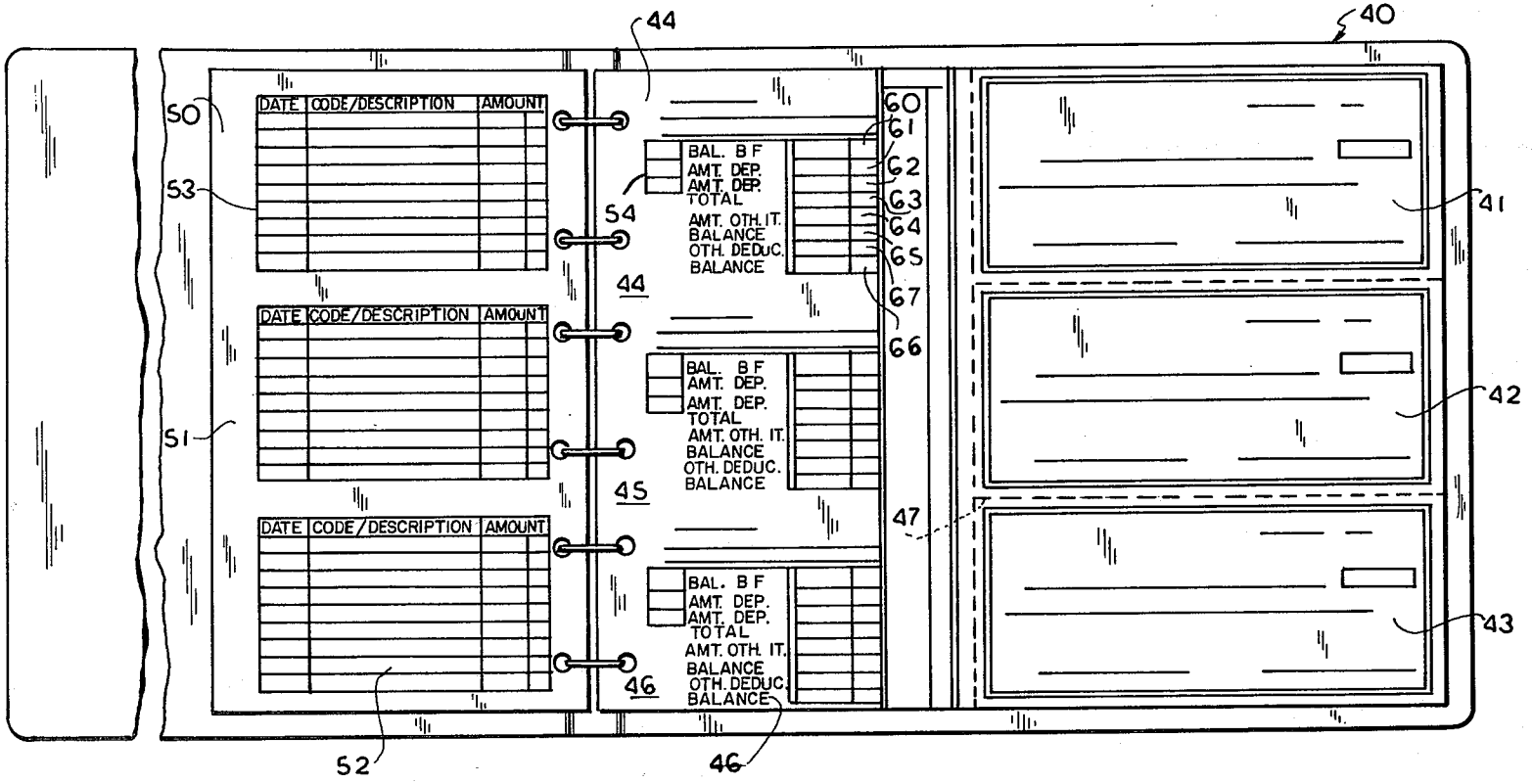
FIG. 2 is a top view of an open "home style" checkbook with checks and stubs, that also embodies features of the invention.

FIG. 2 shows a "home style" checkbook 40. The upper side of three checks 41, 42, 43 and stubs 44, 45, 46, which make up each page, are shown, with the broken lines 47 indicating the score lines between the checks and stubs. The reverse side of the previous three stubs 50, 51, 52 is shown, the stubs being in position after having been flipped over in the checkbook after the detaching of their three acompanying checks.

Solid lines 53 within the outline of the stubs 50, 51, 52 indicate the printing on the reverse side of all stubs in the checkbook, providing spaces in which non-check transactions may be entered with date, description, and amount. The solid lines 54 within the outline of the stubs 44, 45, 46 indicate the printing on the upper side of all stubs in the checkbook. The printing provides a variation of the usual spaces, 60 through 66, for dollars and cents entries of "BALANCE BROUGHT FORWARD" 60, "DEPOSIT" 61, a second "DEPOSIT" 62, "TOTAL" 63, "AMOUNT OF THIS ITEM" 64, "BALANCE" 65, and new "BALANCE CARRIED FORWARD" 66. In addition to these usual spaces, is a space 67 labeled "OTHER DEDUCTIONS (IF ANY)". In space 67, the total of all non-check deductions entered on the reverse side of the third previous stub is to be entered, and the amount deducted, along with the amount of the current check, from the balance forwarded. Note that the non-check deductions entered on the reverse side of stub 50 are totaled and entered in the space provided on the front side of stub 44, deductions from the reverse of stub 51 are to be entered on the front of stub 45, and deductions from the reverse of stub 52 are to be entered on the front of stub 46.

Figure 3:
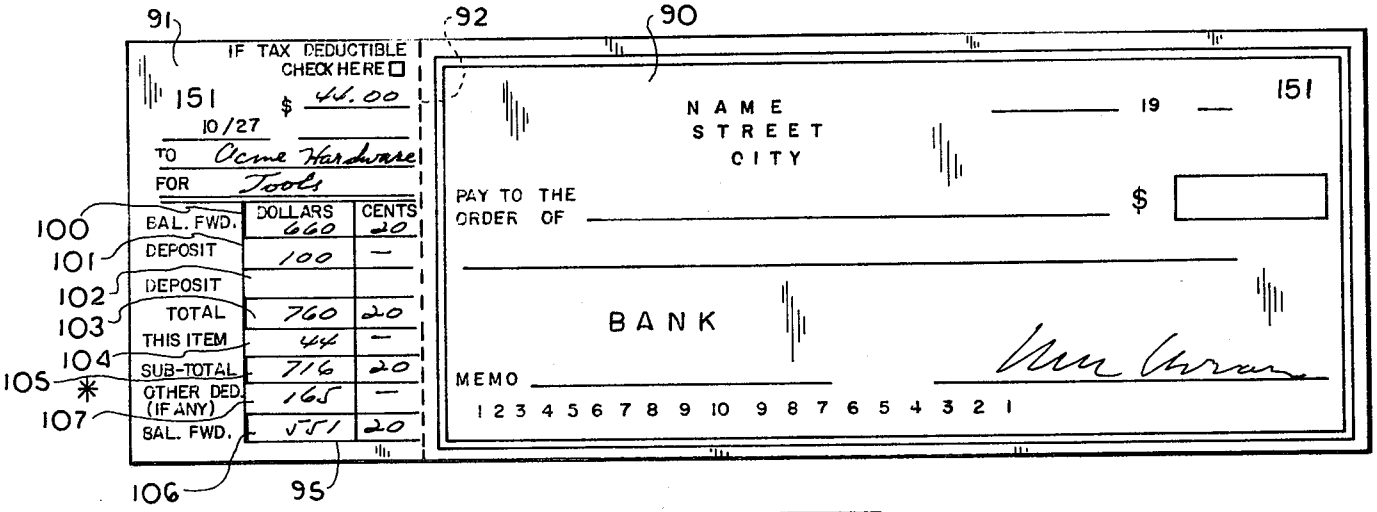
FIG. 3 is a top view of a check and stub for an "end-stub" style checkbook, that also embodies features of the invention.
Figure 4:
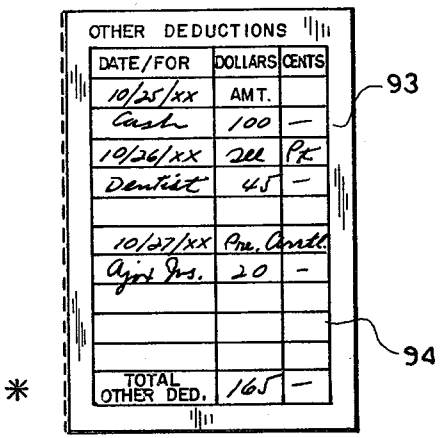
FIG. 4 is a top view of the reverse side of an "end-stub" style check stub, of the type used in connection with the embodiment of the invention.

Turning to FIGS. 3 and 4, FIG. 3 shows an "end-stub" style check 90 and stub 91, with the broken line 92 indicating the score line between the check 90 and stub 91. FIG. 4 shows the reverse side of the previous stub 93 in the position of having been flipped over in the checkbook after the detaching of its accompanying check.

Solid lines 94 within the outline of the stub 93 indicate the printing on the reverse side of all stubs in the checkbook, providing spaces in which non-check transactions may be entered with date, description, and amount. The solid lines 95 within the outline of the stub 91 indicate the printing on the upper side of all stubs in the checkbook. The printing provides a variation of the usual spaces, 100 through 106, for dollars and cents entries of "BAL. FWD." 100, "DEPOSIT" 101, a second "DEPOSIT" 102, "TOTAL" 103, "THIS ITEM" 104, "SUB-TOTAL" 105, and new "BAL. FWD" 106. In addition to these usual spaces, there is a space 107 labeled "OTHER DEDUCT. (IF ANY)". In space 107, the total of all non-check deductions entered on the reverse side of the previous stub is to be entered, and the amount deducted, along with the amount of the current check, from the balance forwarded.

Turning again to FIG. 1, a small portion 80 of the check 22 shows the "safety paper" design, which fully covers the front and back of the check 22, equally applicable to checks 41, 42, 43 in FIG. 2 and check 90 in FIG. 3.

A substantial cost savings in ink can be effected, and an increase in the clarity of the information recorded on the stubs 23 and 26, in accordance with a feature of the invention, through limiting the background design as displayed in the small portion 80 by dropping out the background design during the printing process from the back of the stubs 23 and 26. This selective use of the "safety paper" background design is accomplished by producing the negotiable instrument paper by the standard front and back offset printing process instead of using the traditional flexographic dry process or the wet web process. By using the offset printing process to produce the "safety paper" background design there is total control over the placement of the pattern and hence background can be selectively dropped out to create the outline of a functional form area on the stub. Further reducing costs, the lines 27 and descriptive words relating thereto printed within the blank area may be printed in the same color ink and at the same time as the background design, thus eliminating the need to overprint the back of the stubs through a second printing operation. Alternatively, the background design can be dropped out from the front of the stubs, as well.

FIG. 1 also shows the inside cover of the checkbook 21 provided with pockets 70 and 71. The sides 78 and 78A of the top-most edge of the pocket 70 may be seen extending beyond the edge of stub 23. The cover of pocket 70 is fused to the material of checkbook 21 on three sides and may be made of transparent plastic, allowing the contents of the pocket to be easily seen. The cover of pocket 71 is made of two layers: the underneath layer 83 may be made of opaque plastic and the upper layer, or "over-cover" 84 may be made of transparent plastic. The underneath layer 83 also is fused to the checkbook cover around the three outer edges and the "over-cover" 84 is fused to the underneath layer 83 around all edges. The edges 72 and 72A of the entrance to the pocket 71 may be seen extending beyond the stub 26. The "over-cover" is also joined to the underneath layer along lines 73 and 74. Die cut slits 75, 76, 77, which are slightly wider than the width of a standard credit card or bank transaction card, are formed in the transparent plastic "over-cover". Thus three individual credit card-sized compartments are formed by the cover 83 and "over-cover" 84 of pocket 71.

INDUSTRIAL APPLICABILITY

Thus, there is provided an economical method for producing an efficient checking account record keeping and check disposal system in tune with modern banking practices.

What is claimed is:

1. Apparatus for checking accounts comprising a plurality of pages bound together, each of said pages being divided into a stub adjacent to said page binding and a check detachably secured thereto by means of a score line, printing on the back of said stub providing areas for entering data that is not related to the check that is attached thereto, and printing on the front of said stub providing areas for entering data related to the check attached thereto and data related to data on the back of the adjacent next preceding stub in said plurality of pages in which the total of said deductions may be entered to be subtracted from the balance brought forward, further comprising a substantially rectangular checkbook cover, a piece of transparent material joined along its edge to the full length of one of the edges of said cover and joined to less than half the length of both of two transversely disposed and parallel edges of said cover beginning at the point at which said parallel edges meet said one edge, thus forming a first pocket, a piece of opaque material joined along its edge to the full length of the edge opposite to said one edge of said cover and joined to less than half the length of both parallel edges of said cover beginning at the point at which said parallel edges meet said edge opposite to said one edge of said cover thus forming another pocket, a second piece of transparent material covering said piece of opaque material and joined to said cover along the same edges as said piece of opaque material and joined to said piece of opaque material along an edge opposite the edge which joins said two parallel edges thereof and also joined to said piece of opaque material along two thin lines that correspond to said parallel edges of said cover, said second piece of transparent material having three slits therein each running parallel to and spaced from said thin lines, each slit being slightly wider than the width of a standard credit card, thus forming three individual pockets, and means to join said bound pages of checks and check stubs to said cover along the width-wise midline of said cover.

* * * * *